US005759271A

United States Patent [19]

Buschor

[11] Patent Number: 5,759,271

[45] Date of Patent: Jun. 2, 1998

[54] SPRAY COATING DEVICE FOR ELECTROSTATIC SPRAY COATING

[75] Inventor: Karl Buschor, St Gallen, Switzerland

[73] Assignee: Gema Volstatic AG, Switzerland

[21] Appl. No.: 756,921

[22] Filed: Dec. 4, 1996

[30] Foreign Application Priority Data

Dec. 15, 1995 [DE] Germany ..... 195 46 970.4

[51] Int. Cl.[6] ..... B05B 7/00; B05B 5/025

[52] U.S. Cl. ..... 118/308; 118/629; 239/600; 239/690

[58] Field of Search ..... 118/308, 629; 239/600, 690

[56] References Cited

U.S. PATENT DOCUMENTS

| | | | |
|---|---|---|---|
| 3,270,711 | 9/1966 | Leach | 118/627 |
| 3,448,925 | 6/1969 | Cross | 239/15 |
| 4,196,465 | 4/1980 | Buschor | 361/228 |
| 4,691,865 | 9/1987 | Hoffman et al. | 239/690 |
| 4,779,804 | 10/1988 | Baba et al. | 239/690 |
| 4,798,341 | 1/1989 | Gimple | 239/694 |
| 4,993,645 | 2/1991 | Buschor | 239/708 |
| 5,133,246 | 7/1992 | Campbell | 454/52 |
| 5,402,940 | 4/1995 | Haller et al. | 239/697 |
| 5,584,931 | 12/1996 | Buhlmann | 118/628 |
| 5,636,798 | 6/1997 | Buschor | 239/696 |

FOREIGN PATENT DOCUMENTS

| | | |
|---|---|---|
| 290869 | 11/1988 | European Pat. Off. . |
| 2662620 | 12/1991 | France . |
| 1752212 | 3/1971 | Germany . |
| 2559472 | 12/1976 | Germany . |
| 3014114 | 11/1981 | Germany . |
| 3843639 | 6/1990 | Germany . |
| 3918200 | 12/1990 | Germany . |
| 4312262 | 10/1994 | Germany . |
| 4418288 | 11/1995 | Germany . |

*Primary Examiner*—Peter Chin
*Assistant Examiner*—Jacqueline A. Ruller
*Attorney, Agent, or Firm*—MacMillan, Sobanski & Todd

[57] ABSTRACT

A spray coating device for the electrostatic spray coating of articles. The device includes a spray appliance which is carried by an elongated tubular support housing through which all connecting conduits for the spray appliance extend. The tubular support can be supported by a carrier device, such as a reciprocator, located outside of a spray booth and can extend through a side wall opening in the spray booth for positioning the spray appliance in the spray booth. The spray appliance may be a powder coating material applicator. Preferably, the top surfaces of the spray appliance and the tubular carrier are substantially continuous and without significant steps and of the smallest possible size in order to minimize the deposit of coating material and dust.

8 Claims, 4 Drawing Sheets

SPRAY COATING DEVICE FOR ELECTROSTATIC SPRAY COATING

BACKGROUND OF THE INVENTION

The invention relates to spray coating apparatus and more specifically to a device for electrostatic spray coating articles, especially with powder.

Electrostatic spray coating devices for electrostatic spray coating articles with coating powder are well known in the art. According to published German patent specification DE-A 44 18 288, the spray device may have an oblong housing in the form of a gun barrel, a coating material duct extending through the housing in its longitudinal direction, and a nozzle for atomizing the coating material on a downstream front end of the coating material duct. The housing accommodates a high voltage generator for generating a high voltage and for applying the high voltage to an electrode which electrostatically charges the coating material. The high voltage generator is arranged in the spray device housing above a powder duct which extends longitudinally through the housing. The housing has an upwardly expanded area for accommodating the high voltage generator. It is generally known to make the gun housing of an electrically insulating plastic and either to embed the electric voltage generator in the housing material or to arrange it in the housing so as to be replaceable.

The prior art spray device could be mounted on a robot arm. All connecting lines (for coating material, for electric voltage on the primary side of the voltage generator, and for compressed air) are routed through the robot arm and connected to a rear end face of the spray device where it is secured to the robot arm. The compressed air serves to sweep the high voltage electrode so as to prevent coating powder from collecting on the electrode. Furthermore, the compressed air can be used to support the atomization process or for blowout of powder residues in the spray device during a cleaning operation. Several of the spray devices can be fastened with their rear end faces secured to a beam which is attached to the robot arm.

It is also known from U.S. Pat. No. 4,196,465 that the components of a high voltage generator may be arranged in a spray gun housing below a duct which carries the coating powder. A handle is detachably fastened to the barrel of the spray gun. This allows manual use of the spray gun or, without the handle, use on a stationary stand, on a reciprocator or on a robot arm. In order to attach the gun barrel to a stand, arms fastened to the stand are required. The arms must extend through an opening in a wall of a spray booth in which the gun barrel must be arranged for coating articles. The lines for the coating material, for electric voltage and for compressed air extend separately from the gun barrel through the wall opening of the booth. When a reciprocator is used, the lines must have a loop allowing the sections connected to the gun barrel to move in relationship to the stationary upstream line sections that are arranged outside the booth.

When coating with powder, the separate lines extending from inside the spray booth to the exterior of the booth tend to collect coating powder and dust. This makes it difficult to change coating color or coating materials, since significant work is required in cleaning the old powder from the spray device and the attached lines.

BRIEF SUMMARY OF THE INVENTION

The invention is directed to a spray coating device suitable for use with powder coating materials. The spray device can be supported by a stationary stand, or a reciprocator or other positioning machines arranged outside the spray booth. The spray device is easily cleaned when changing coating colors or coating materials. According to the invention, all lines are accommodated in a tubular support housing serving as a support for the spray device. The support housing has a top surface which is substantially smooth in a longitudinal direction and rounded in a transverse direction to prevent powder and dust buildup and to facilitate cleaning. The support housing is supported by a positioning device arranged outside of the spray booth. The support housing can extend from the positioning device through a wall opening in the spray booth and possesses a length required for that purpose, ranging from between 30 cm and 200 cm.

Various objects and advantages of the invention will become apparent from the following detailed description of the invention and the accompanying drawings.

DETAILED DESCRIPTION OF THE INVENTION

Figure 3:
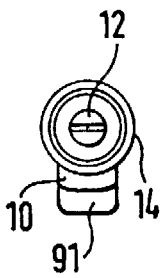
FIG. 3 is a front end view of the spray coating device of FIG. 1.
Figure 1:
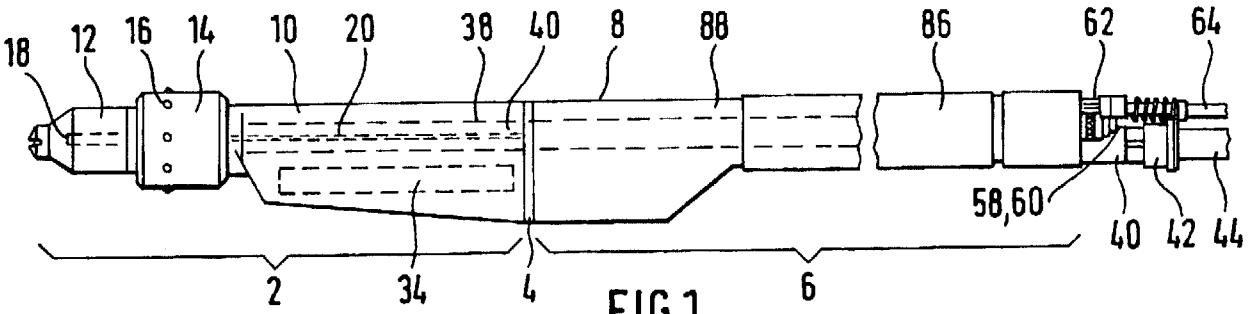
FIG. 1 is a side elevational view of a spray coating device according to the invention.
Figure 2:
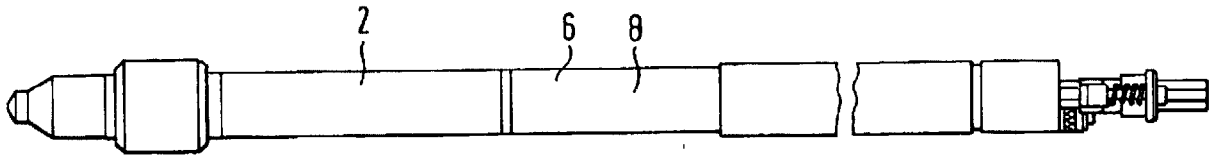
FIG. 2 is a top plan view of the spray coating device of FIG. 1.

FIGS. 1–8 illustrate a spray coating device according to the invention for electrostatic spray coating articles with a powder coating material. However, the device alternately may be designed for spray coating liquids. The spray coating device includes a spray apparatus or device 2, an adapter 4 and a tubular support 6. They are arranged successively in a way such that their surfaces are flush and their entire upper back line 8, as seen in FIG. 1, is straight and without significant steps. At least the surface forming the back line 8 of all three parts 2, 4 and 6 is rounded in a direction transverse to the longitudinal axis. Also, side surfaces of the spray device 2, the adapter 4 and the tubular support 6 are flush and straight lined without significant steps, as shown in FIG. 2. Thus, coating powder and dust have little opportunity to settle on the spray device 2, the adapter 4 and/or the tubular support 6.

Figure 5A:
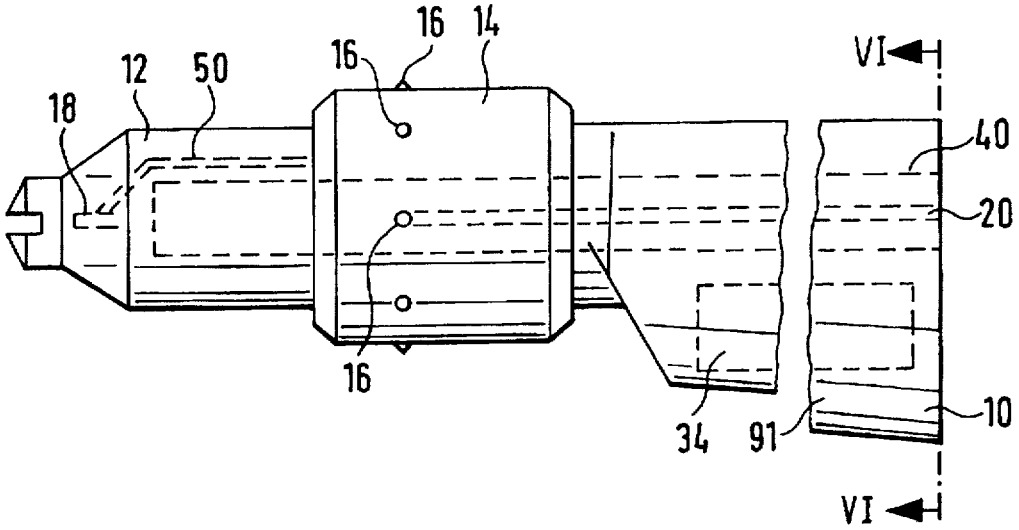
FIG. 5A is an enlarged fragmentary side elevational view of a powder coating spray gun or device which forms a front end section of the spray coating device of FIG. 1.
Figure 5B:
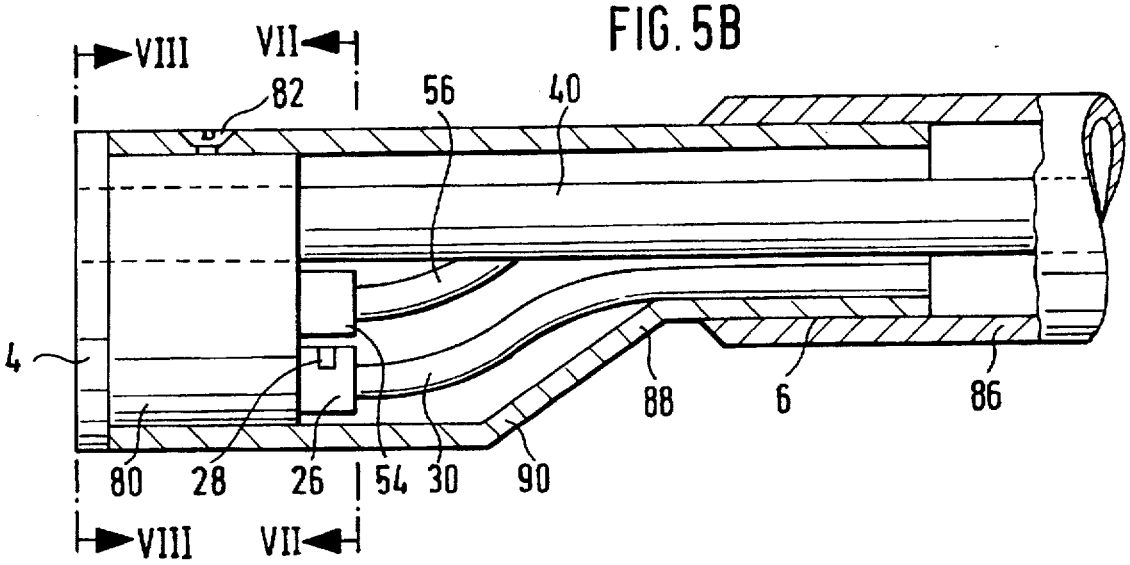
FIG. 5B is an enlarged fragmentary side elevational view, in partial section, of the middle section of the spray coating device of FIG. 1 showing details of an adapter and of a front end portion of the tubular support.
Figure 5C:
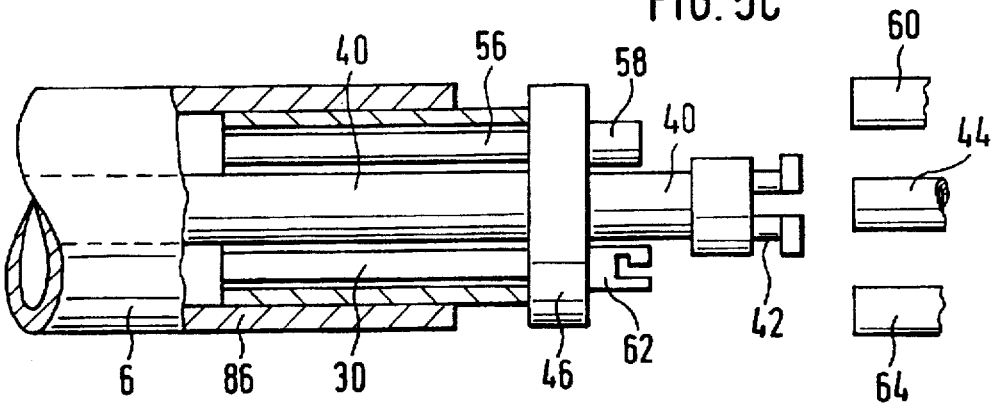
FIG. 5C is an enlarged fragmentary side elevational view, in partial section, of the rear end section of the spray coating device of FIG. 1 showing details of the rear end portion of the tubular support.

As best seen in FIGS. 1 and 5A, the coating powder spray applicator or device 2 has a housing 10 in the form of a gun barrel and has on the front end of the housing 10 a spray nozzle 12 for atomizing or discharging the coating material. For liquids, either a rotary atomizer or a spray nozzle 12 may be used for atomizing the liquid. An electrode holder ring 14 is slipped onto a front housing section from the front. The electrode holder ring 14 has a plurality of ion arrester electrodes 16 on its circumference. The electrodes 16 are circumferentially spaced and arranged behind the tip of the nozzle 12 for arresting free ions generated by the voltage of a high voltage electrode 18. The high voltage electrode 18 is positioned either within the nozzle 12 as shown or outside the nozzle 12 (not shown) to electrostatically charge the coating material. The "free" ions are the electrical charged particles which cannot contribute to a favorable electrostatic charging of the coating material because they either are too far removed from the coating material or the coating material within their reach is already saturated with ions.

The ion arrester electrodes 16 are connected to an electrically conducting arrester wire 20 which extends in an axially parallel direction from the ring 14. As the ring 14 is slipped onto the front section of the housing 10, the wire 20 passes through an axially parallel housing bore up to the adapter 4 and makes contact with an electrical contact 22 (FIG. 7) on the adapter 4. The contact 22 on the adapter 4 is connected via conductors 23 and 25 and an electrically conductive ring 24 to a quarter turn or bayonet connector 26. The connector 26 allows connection of a mating plug 28 (FIG. 5B) on a low voltage insulated cable 30. The cable 30 electrically grounds the ion arrester electrodes 16 and also has electric lines which make contact with electric contacts 32 arranged on the rear end face of the spray device 2 (FIG. 6) so as to feed power to a high voltage generator 34. The high voltage generator 34 is arranged in the housing 10 of the spray device 2 to provide a high voltage to the electrode 18 for imparting an electrostatic charge to the coating material.

The voltage generator 34 is arranged in the housing 10 below an axially aligned duct 38 on the nozzle 12. A coating material tube 40 extends through the duct 38 to the nozzle 12. From the duct 38, the tube 40 extends through the adapter 4 and the tubular support 6 up to its rear end. The tube 40 protrudes from the rear end of the tubular support 6 and is terminated at a connector 42 which is adapted for connecting to an external coating material supply hose 44. A plug 46 is inserted into the rear end of the tubular support 6 to form a dustproof seal. The coating material tube 40 slides through a bore in the plug 46.

Figure 6:
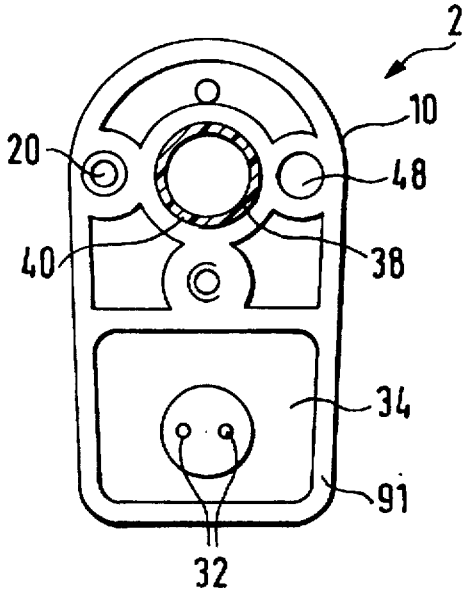
FIG. 6 is a cross sectional view as taken along line VI—VI of FIG. 5A.
Figure 7:
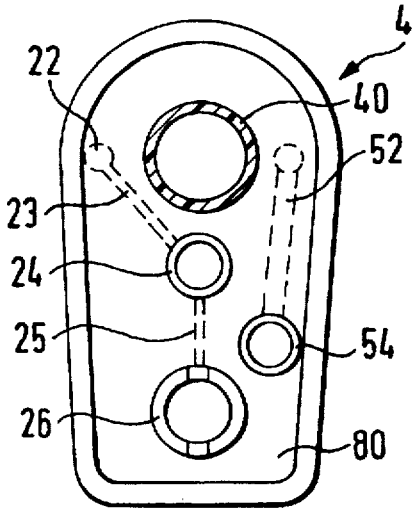
FIG. 7 is a cross sectional view as taken along line VII—VII of FIG. 5B.
Figure 8:
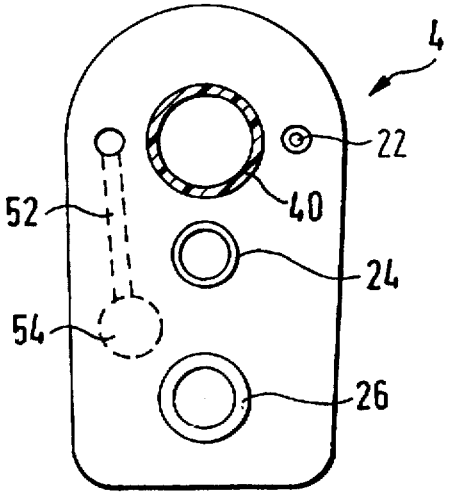
FIG. 8 is a cross sectional view as taken along line VIII—VIII of FIG. 5B.

A compressed air duct 50 extends from the electrode 18 in the spray device 2 to a compressed air inlet 48 on the rear end face of the spray device 2, as shown in FIGS. 5A and 6. Compressed air discharged from the duct 50 sweeps over the electrode 18 to prevent any buildup of coating powder on the electrode 18. As shown in FIGS. 7 and 8, the adapter 4 has a connecting duct 52 which extends from an adapter front face to an adapter rear face. The adapter duct 52 connects with the compressed air inlet 48 on the device 2. The adapter duct 52 is terminated at the adapter rear face at a connector 54, which preferably is in the form of a bushing to which a compressed air hose 56 can be detachably connected. The hose 56 extends through the tubular support 6 up to the rear plug 46 and connects there to an external connector 58 for detachable connection of an external compressed air hose 60. The rear end of the low voltage cable 30 also passes through the plug 46 and terminates at a connector 62 for connection to an external electric cable 64.

Figure 10:
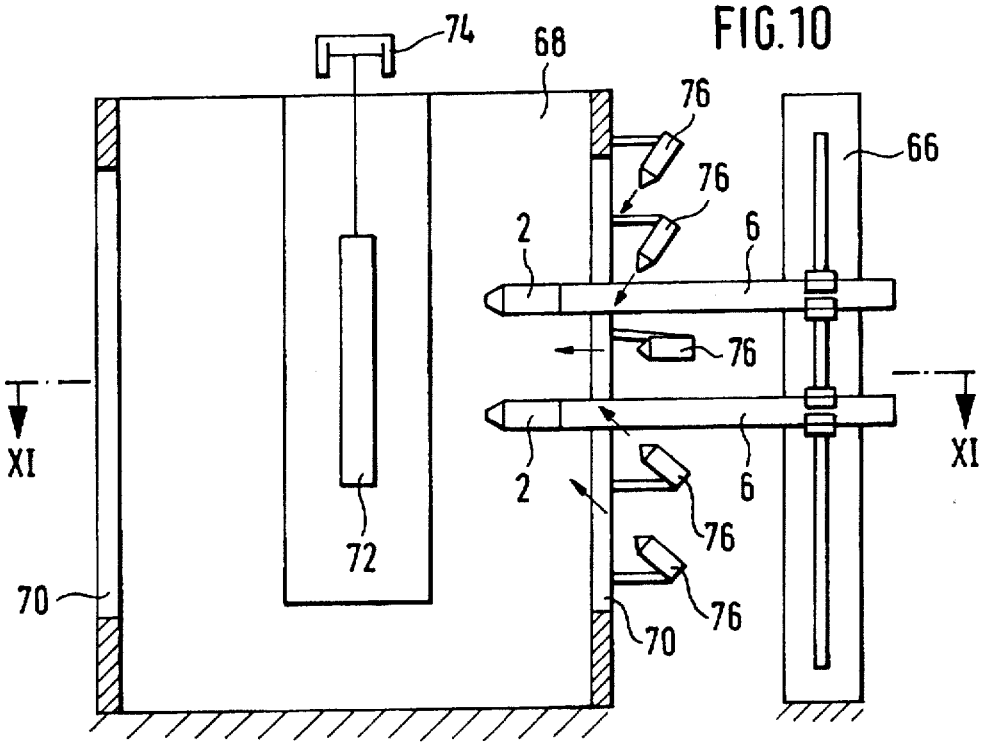
FIG. 10 is a diagrammatic view, in partial section, of a spray booth with two spray coating devices according to the invention mounted on a reciprocator.
Figure 11:
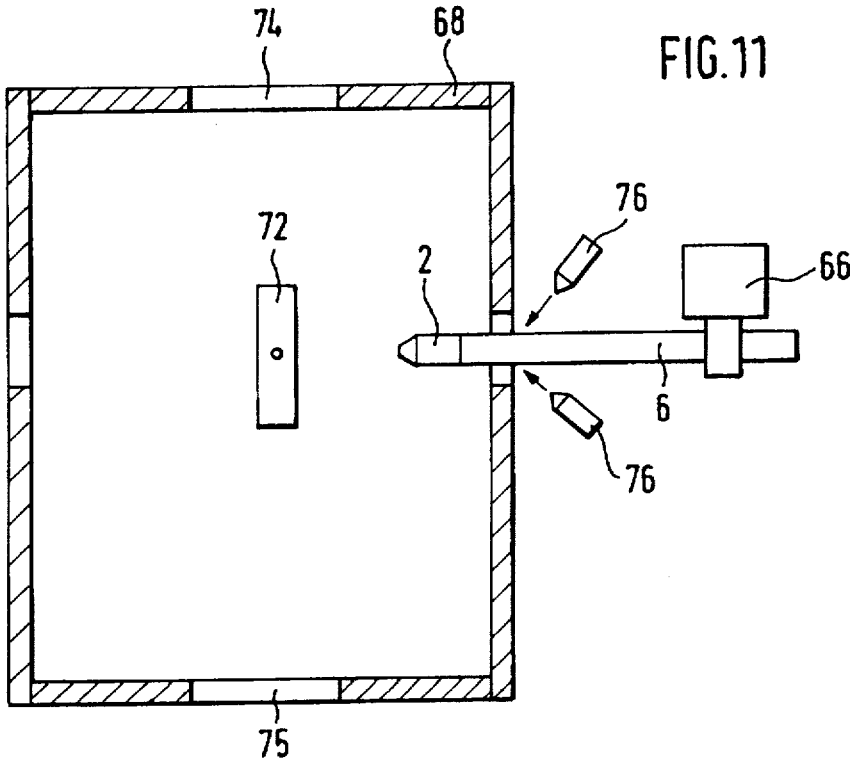
FIG. 11 is a cross sectional view as taken along line XI—XI of FIG. 10.

The periphery of the adapter 4 has the same shape and size at its front end as the rear end of the spray device 2, and at its rear end as the front end of the tubular support 6. Thus, the outside surfaces are flush and merge into one another without any significant step. The adapter 4 and the tubular support 6 form together a tubular support housing which at its front end supports the spray device 2, while at its rear end is supported by a positioning device 66, such as is illustrated in FIGS. 10 and 11. The positioning device may either keep the spray device 2 stationary or may be controlled by a computer (not shown) to move vertically and/or horizontally in the longitudinal and/or transverse direction relative to a spray booth 68. The positioning device 66 may support one or several (two shown in FIGS. 10 and 11) tubular support 6 that extend through a wall opening 70 in the spray booth 68 for positioning the spray devices 2 within the spray booth 68. The spray devices 2 spray coating material on an article 72 being coated in the spray booth 68. The article 72 may be moved through the spray booth 68 by a continuous conveyor 74. In an opposite wall of the spray booth 68, another wall opening 70 may be provided for introducing additional spray devices 2 or for a filter for sucking powder laden air out of the spray booth 68, such as is well known in the prior art. The articles 72 being coated pass through an end wall opening 74 into the booth and out of it again through another opposite end wall opening 75. Compressed air nozzles 76 may be arranged at the wall opening 70 for the spray devices 2 for directing compressed air at the spray devices 2 and their tubular support 6. The air flow from the nozzles 76 blows powder off the tubular support 6 and spray device 2 and into the booth 68, notably when the spray device 2 is removed from the spray booth 68. This allows a quick color change or a change from one powder type to another. According to FIG. 10, the compressed air nozzles 76 may be mounted on the spray booth 68 or they may be mounted on another support device (not shown).

In the assembly of the spray coating device of FIGS. 1–8, the adapter 4 is first assembled to the rear end face of the housing 10 of the spray device 2, as illustrated in FIG. 6. The adapter 4 is attached to the housing 10 with, for example, a sheet metal screw (not shown) which protrudes through and electrically contacts the electrically conductive ring 24. Hence, the adapter 4 is electrically grounded via the connector 26 and the low voltage cable 30. Next, the end of the low voltage cable 30 protruding out of the front end of the tubular support 6 is connected to the connector 26 and the end of the compressed air hose 56 is connected to the compressed air connector 54 on the adapter 4. The coating material tube 40, with its section protruding forward and out of the tubular support 6, either was already slipped or is now slipped through the duct 38 in the housing 10 to the nozzle 12. Another procedure provides for inserting the coating material tube 40 through the tubular support 6 and the housing 10 up to the nozzle 12 after the tubular support 6 has been secured to the adapter 4. The adapter 4 has a projection 80 having an outer periphery which is adapted in shape and size to the inside periphery of the front end section of the tubular support 6 to form with it a telescopic engagement. This allows slipping the front end section of the tubular support 6 on the projection 80. A screw 82 locks the tubular support 6 and the adapter 4 together. The plug 46 is arranged to slide in an axial fashion in the tubular support 6, as shown in FIG. 5C. This allows the low voltage cable 30 and the compressed air hose 56 to move in an axial direction in the tubular support 6 after they are secured to the adapter 4 and as the tubular support 6 is slipped onto or separated from the adapter 4. Following assembly, a substantial portion of the plug 46 can be pushed back into the tubular support 6. The length of the tubular support 6 may range between 30 cm and 200 cm, and is preferably about 120 cm, depending on how far the positioning device 66 needs to be positioned from the booth 68 in order to direct the spray devices 2 within the booth 68 at the article 72 to be coated.

The spray device housing 10 needs to have a cross section greater than for accommodation of the coating material tube 40, the low voltage cable 30 and the compressed air hose 56. In order to keep the outside surfaces of the tubular support 6 as small as possible and to create minimally few or no surface unevenness, the tubular support 6 consists of an elongated tube 86 and a much shorter tubular adapter 88, as shown in FIGS. 1, 2 and 5A–C. The interior cross section of the tube 86 is only a little larger than necessary for accommodating the coating material tube 40, the low voltage cable 30, the compressed air hose 56, and any other connecting lines required by the spray coating device 2. The front end of the tubular adapter 88 is of a size and shape for receiving the adapter projection 80. The rear end of the tubular adapter 88 is adapted to join the tube 86. The tubular adapter 88 and the tube 86 may be nested or butted and joined, for example, by a crimp, by adhesive, by welding, by soldering or by other known means. The tubular adapter 88 has a straight longitudinal top or back line which is substantially flush with the tops of the housing 10 and the tube 86. The underside of the tubular adapter 88 is reduced obliquely in funnel fashion from the larger diameter of the housing 10 and adapter 4 to the smaller diameter of the tube 86. This gives the tubular adapter 88 a downward bulge 90 which matches a similar bulge in the housing 10. The housing 10 needs the bulge for accommodating the high voltage generator 34 underneath the coating material tube 40. According to another embodiment, the voltage generator 34 could be arranged above the coating material tube 40, in which case the bulge of the housing 10 and the bulge 90 of the tubular adapter 88 would be directed upward. With the bulge directed upwardly, more powder can settle on the spray device 2 and the adapter 88, since the upward surface thus is greater. Therefore, the preferred embodiment has the bulge directed downwardly.

The invention is not limited to spray devices 2 which require a voltage generator 34. The voltage generator 34 could be arranged outside of the spray device 2 in the tubular support 6, or also outside of the tubular support 6, in which case the low voltage cable 30 would need to be replaced with a high voltage cable. If the coating material is electrostatically charged by friction, or triboelectrically, the high voltage generator 34 and the low voltage cable 30 may be totally eliminated. The electrostatic charging of the powder in such devices takes place by friction as the powder moves along the wall of the coating material tube 40. The interior wall of the coating material tube 40 is provided with a surface material suited for electrostatic charging the powder by friction. In all embodiments, the coating material tube 40 is preferably of an electrically insulating plastic material. If the spray device 2 is designed to spray electrically conductive liquid coating material, the coating material can be charged to a high voltage at its supply source.

Figure 9:
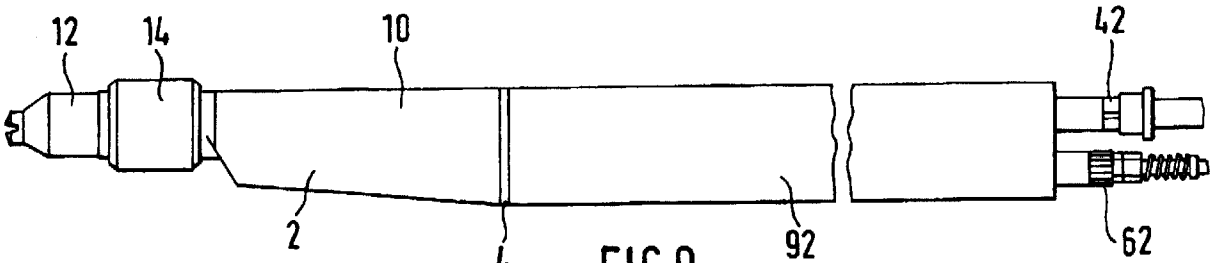
FIG. 9 is a side elevational view of a further embodiment of a spray coating device according to the invention.
Figure 4:
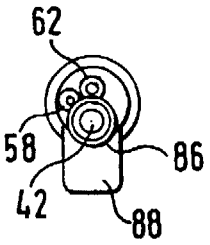
FIG. 4 is a rear end view of the spray coating device of FIG. 1.

FIG. 9 illustrates an embodiment identical to the embodiment of FIGS. 1–8, except that the tubular support 6 is replaced with a tubular support 92 which on its entire length has an oval cross sectional shape matching the rear end of the spray device housing 10. The tubular support 6 of FIGS. 1–8 and the tubular support 92 of FIG. 9 each form with the adapter 4 a support housing for the spray device 2. The support housing accommodates all connecting lines for the spray device 2. This results in the smallest possible number and the smallest possible size of the surfaces on which coating powder and dust can deposit and which must be cleaned. As a result, color changes can be made more quickly.

According to a further (not shown) embodiment, the housing 10 of the spray device 2 may have a shape on its rear end which deviates from an oval shape. For example, the rear end of the housing 10 may have a round cross sectional shape. The cross sectional shape of the front end of the tubular support 6 or 92 is in all embodiments adapted to the specific cross sectional shape of the rear end of the spray device 2.

It will be appreciated that various modifications and changes may be made to the above described preferred embodiment of a spray coating device without departing from the scope of the following claims.

I claim:

1. In a spray coating device for the electrostatic spray coating of articles with powder coating material including a spray appliance which has a spray appliance housing, said spray appliance having at least one connecting conduit extending from a rear end of said spray appliance housing, said at least one connecting conduit including a coating material conduit extending in a longitudinal direction through said spray appliance housing, and a coating material atomizer at a downstream end of the coating material duct, the improvement comprising a tubular support housing secured to said rear end of said appliance housing, said tubular support housing extending in a rearwards direction away from said spray appliance housing, and wherein all connecting conduits from said spray appliance extend through said tubular support housing, and wherein said tubular support housing includes an adapter which interconnects said spray appliance housing with said tubular support housing, wherein said adapter has a front end releasably secured to said rear end of said spray appliance housing and a rear end releasably secured to a front end of said tubular support housing.

2. A spray coating device according to claim 1, wherein said spray appliance housing, said adapter and said tubular support housing extend in the longitudinal direction and have top surfaces which extend substantially continuously in a linear fashion in the longitudinal direction, and wherein said top surfaces are rounded in a direction transverse to the longitudinal direction.

3. A spray coating device according to claim 2, and wherein said tubular support housing has a length of between about 30 cm and 200 cm.

4. A spray coating device according to claim 2, wherein said spray appliance housing has an enlarged lower rear section extending to said rear end of said spray appliance housing for enclosing a high voltage generator mounted below said coating material duct, and wherein said adapter and said front end of said tubular support housing have perimeters which substantially correspond to the periphery of said rear end of said spray appliance housing.

5. A spray coating device according to claim 4, and wherein said tubular support housing has a front section connected to an elongated small diameter tubular rear section which is longer than said front section, said front section having an outer surface tapering from substantially the perimeter of said front end of said tubular support housing to the small diameter of said tubular rear section.

6. A spray coating device according to claim 5, and wherein said tubular support housing and said spray appliance housing are arranged with a common longitudinal axis, wherein said coating material conduit extends through said tubular support housing and through said spray appliance housing along said longitudinal axis to said coating material atomizer, and wherein said coating material conduit is adapted to be removed and replaced from said spray coating device without separating said spray appliance from said tubular support housing.

7. A spray coating device according to claim 5, and further including a plug closing said rear end of said tubular support housing, wherein said adapter has openings for passing and sealing to each of said at least one connecting conduit, and wherein said plug is adapted to slide in and seal to an interior wall of said tubular rear section of said tubular support housing.

8. A spray coating device according to claim 7, and wherein said at least one connecting conduit includes an air conduit extending through said spray appliance to said rear end of said spray appliance housing and a wire extending from said high voltage generator to said rear end of said spray appliance housing, wherein said tubular support housing includes a pressurized air supply conduit and a low voltage electric supply wire extending from said adapter through said tubular support housing and said plug, wherein said adapter includes means for connecting said pressurized air supply conduit to said spray appliance air conduit at said rear end of said spray appliance housing when said spray appliance is secured to said adapter, and means for connecting said low voltage electric supply wire to said spray appliance wire at the rear end of said spray appliance housing when said spray appliance is secured to said adapter.

* * * * *